US008757622B1

(12) United States Patent
King

(10) Patent No.: US 8,757,622 B1
(45) Date of Patent: Jun. 24, 2014

(54) BINGO TABLE GAME AND METHOD OF PLAYING BINGO

(71) Applicant: innovate! Technologies Group, LLC, Montgomery, AL (US)

(72) Inventor: Troy Robin King, Montgomery, AL (US)

(73) Assignee: innovate! Technologies Group, LLC, Montgomery, AL (US)

( * ) Notice: Subject to any disclaimer, the term of this patent is extended or adjusted under 35 U.S.C. 154(b) by 0 days.

(21) Appl. No.: 13/718,254

(22) Filed: Dec. 18, 2012

(51) Int. Cl.
*A63F 3/00* (2006.01)

(52) U.S. Cl.
USPC ..... 273/269; 273/274

(58) Field of Classification Search
USPC ..... 273/274, 146, 269
See application file for complete search history.

(56) References Cited

U.S. PATENT DOCUMENTS

| | | | | |
|---|---|---|---|---|
| 4,364,567 | A * | 12/1982 | Goott | 273/237 |
| 5,788,240 | A * | 8/1998 | Feinberg | 273/274 |
| 6,679,495 | B1 * | 1/2004 | Endelicato | 273/269 |
| 6,688,597 | B2 * | 2/2004 | Jones | 273/274 |
| 7,717,785 | B2 | 5/2010 | Odom | |
| 7,753,774 | B2 | 7/2010 | Gail et al. | |
| 7,955,170 | B2 | 6/2011 | Gail et al. | |
| 8,197,326 | B2 | 6/2012 | Chamberlain et al. | |
| 8,235,787 | B2 | 8/2012 | Lind et al. | |
| 8,585,506 | B2 * | 11/2013 | Sareli et al. | 463/42 |
| 2001/0035604 | A1 * | 11/2001 | Jones | 273/139 |
| 2004/0072610 | A1 | 4/2004 | White et al. | |
| 2005/0101387 | A1 | 5/2005 | Wolf | |
| 2006/0014582 | A1 | 1/2006 | Harris et al. | |
| 2006/0014583 | A1 | 1/2006 | Harris et al. | |
| 2006/0046827 | A1 | 3/2006 | Saffari et al. | |
| 2007/0032289 | A1 | 2/2007 | Sims et al. | |
| 2007/0060269 | A1 | 3/2007 | Ruppert et al. | |
| 2008/0032762 | A1 | 2/2008 | Kane et al. | |
| 2009/0036194 | A1 | 2/2009 | Naicker et al. | |
| 2010/0124984 | A1 | 5/2010 | DePalma et al. | |
| 2011/0039610 | A1 | 2/2011 | Baerlocher et al. | |
| 2012/0122550 | A1 | 5/2012 | Johnson et al. | |

* cited by examiner

*Primary Examiner* — William Pierce
(74) *Attorney, Agent, or Firm* — Womble Carlyle Sandridge & Rice LLP

(57) ABSTRACT

A bingo table game includes a table with a playing surface that evokes the appearance of a table for playing craps. Players grouped around the table purchase bingo cards by placing chips in designated regions of the playing surface. Both a Primary Bingo Game card and Interim Bingo Game cards can be purchased or activated by placing chips in their corresponding regions. Cube-shaped bingo balls are randomly selected and rolled onto the playing surface by a blower mechanism to imitate a dice roll. The bingo indicium on each bingo ball is called out as it completes its roll. Players daub any indicia on their bingo cards that match the indicium on the ball. Interim games can be won on each "roll" of a bingo ball by a single match and daub, and payouts for that interim game can be paid to winning players after each roll. This continues until one or more players wins the Primary Bingo Game, whereupon chips remaining in the Interim Bingo Game regions are retained by the house and chips in the primary game region are awarded to the winner of the Primary Bingo Game.

10 Claims, 4 Drawing Sheets

BINGO TABLE GAME AND METHOD OF PLAYING BINGO

TECHNICAL FIELD

This disclosure relates generally to the game of bingo and more specifically to a bingo table game that provides a more enjoyable experience for players, and to a method of playing bingo embodied therein.

BACKGROUND

The game of bingo traditionally is played by a plurality of players, each of whom holds a card bearing numbers arranged in a 5 by 5 matrix with the letters BINGO heading respective columns of numbers. A bingo game caller draws bingo balls randomly generated by a bingo blower, each bingo ball being printed with a combination of a letter and a number. For example, a bingo ball may be printed with the designation "B-8" corresponding to a number 8 in the B column of the matrix or "O-74" corresponding to the number 74 in the O column of the matrix. If a drawn combination of column and number appears on a player's bingo card, then the player covers the number on his or her card.

A bingo game is won, i.e. a "BINGO" is obtained, by the first person or persons covering a pre-designated pattern of numbers on his or her bingo card. There are a large number of possible patterns that can be designated as winning patterns, but most fall within the categories of static patterns (patterns that cannot be rotated or shifted), crazy patterns (patterns that can be rotated by 90, 180, or 270 degrees), or wild patterns (patterns that are fixed but can be shifted up and down or sided to side). For example, a wild pattern comprising a line of covered numbers across a bingo card may be designated as a winning pattern. The first player to obtain a line of covered numbers across any of the five rows of his or her bingo card may declare "BINGO" and win the game. Alternatively, a pattern of one covered number in the left column and one in the right column of a bingo card or simply a number in one designated column may be designated as a winning pattern. Any one or more of the very large number of possible patterns may be designated as a winning pattern including, for instance, happy faces, airplanes, diagonal lines, letters of the alphabet, around the corners, and so on.

In many states, traditional bingo and other games similar to bingo, which satisfy particular legal requirements, may be played for charitable purposes as well as in Native American gaming establishments on Native American land placed into trust for gaming by the Department of Interior, or on a Native American Tribe's reservation. These are sometimes referred to as Native American casinos. High stakes bingo has evolved over the years within Native American gaming facilities as Class II gaming where Class III gaming is prohibited. Such high stakes bingo has received considerable attention in recent years, and many Native American Tribes have invested in high end casino-like facilities where Class II bingo and other Class II games such as pull-tabs and electronic bingo can be played. Although traditional high stakes bingo has grown in popularity over the years, it typically requires a lot of space and a relatively large number of players to be economically feasible. Further, high stakes bingo has generally remained quite traditional and basic, lacking not only the excitement of Vegas-style gaming but also the intimacy and fast action of electronic gaming and traditional table games such as blackjack, poker, roulette and craps.

Variations in the game of bingo have been offered in the past in attempts to increase the excitement of play while striving to comply with the basic legal requirements for permissible bingo games. Some of these variations have attempted to adapt bingo to table play, with hopes of capturing the intimacy and excitement of traditional table games. One such form of bingo, generally known as "fast action" bingo and sometimes referred to as "lightning" or "bullet" bingo, while differing from traditional bingo by using a limited group of numbers (and in some cases three numbers), are nevertheless labor intensive and require large numbers of players to be financially successful, both for the players and for the bingo game operator.

U.S. Pat. No. 5,823,534 of Banyai discloses a bingo table game including a table having player stations arrayed around the table. Players sit around the table in an intimate group. The game permits each player to select a set of numbers to be matched during play by randomly drawn numbers on bingo balls. The selection may include a wild designation, which each player may deem to match one of his or her selected numbers. A dealer or caller draws random numbers printed on bingo balls and a "bingo" occurs whenever a player has matched all of his or her selected numbers to a set of randomly drawn numbers. The game is permitted to progress at multiple levels of play notwithstanding the occurrence of prior bingos in the game being played. While the bingo table game of Banyai may be a step in the right direction, it nevertheless remains quite simplified and still does not provide players with the more exciting experience of playing a Vegas-style betting game.

A need therefore persists for a Class II bingo table game and a method of playing bingo that supplies players with the excitement, intimacy, and enjoyment of playing a Vegas-style Class III casino game while complying with the legal definitions of Class II Bingo. It is to the provision of such a table game and method that the present invention is primarily directed.

SUMMARY

Briefly described, a bingo table game is disclosed that includes a table having a playing surface at least partially surrounded by an upwardly extending peripheral parapet to resemble a traditional craps table. The playing surface has graphics printed thereon that evoke the appearance of a table for playing the traditional betting game of craps. Chips are purchased and used by players during game play to buy bingo cards. A Bingo Session includes a Primary Bingo Game and Interim Bingo Games that are played while the Primary Bingo Game is in progress. Primary Bingo Game cards are purchased by players for playing the Primary Bingo Game and Interim Bingo Game cards are purchased by players for playing one of a number of possible Interim Bingo Games. The craps evoking graphics on the playing surface includes at least one first region designated for receiving chips used to purchase Primary Bingo Game cards for playing the Primary Bingo Game. The graphics also has at least one second region (preferably a plurality of second regions) designated for receiving chips used to purchase Interim Bingo Game cards for playing at least one Interim Bingo Game during play of a Primary Bingo Game.

A plurality of bingo balls have designations printed thereon that are associated either with locations on the Primary Bingo Game cards or locations on the Interim Bingo Game cards. In one embodiment, the bingo balls are cube-shaped to evoke the appearance of dice and some of the balls have fanciful dice-like dots printed on some faces of the ball. A mechanism, preferably a blower, is associated with the table for delivering randomly selected ones of the bingo balls onto the playing surface of the table. A human bingo dealer verbally announces the designation printed on the ball such as, for instance "O-75." Players then cover or daub any matching numbers on their primary bingo cards. They also daub any matching numbers on any interim bingo cards they may have purchased before the roll of each bingo ball. The designated winning pattern for an Interim Bingo Game may be a single match on an interim bingo card and the designated winning pattern for the Primary Bingo Game may be a match in both the left and right columns of a primary bingo card.

Following each roll of a bingo ball, players of Interim Bingo Games having matches are "winners" and are paid chips according to a designated payout ratio associated with the Interim Bingo Game that they won. In some Interim Bingo Games the chips used to purchase interim bingo cards of losing players are removed from their positions. In some Interim Bingo Games the chips remain on the table allowing winnings to be paid during subsequent Interim Bingo Games until the designated Primary Bingo Game winning pattern is drawn, daubed, announced, and verified. Players may then purchase interim bingo cards to play another round of Interim Bingo Games on the next roll of a bingo ball. Interim Bingo Games continue to be played on each roll of a bingo ball until one or more players declares BINGO in the Primary Bingo Game. The winner or winners of the Primary Bingo Game then are paid from all of the chips of all players that purchased primary bingo cards, with the house having no interest or involvement in the Primary Bingo Game. Then a new Bingo Session is started as players again place chips on the table to purchase primary and interim bingo cards.

It will thus be seen that a bingo table game and a method of playing bingo is now provided that is intimate, fast paced, fun, and that provides players with a playing experience that evokes the experience of playing a traditional casino game of craps. These and other aspects, features, and advantages of the table game and method of this invention will be better appreciated by the skilled artisan upon review of the detailed description set forth below, taken in conjunction with the accompanying drawing figures, which are briefly described as follows.

DETAILED DESCRIPTION

The invention will now be described in detail. First, the bingo table, playing surface, and accessories will be described in some detail and, following that description, the method of playing bingo according to the invention will be described in detail.

The Bingo Table and Accessories

Figure 1:
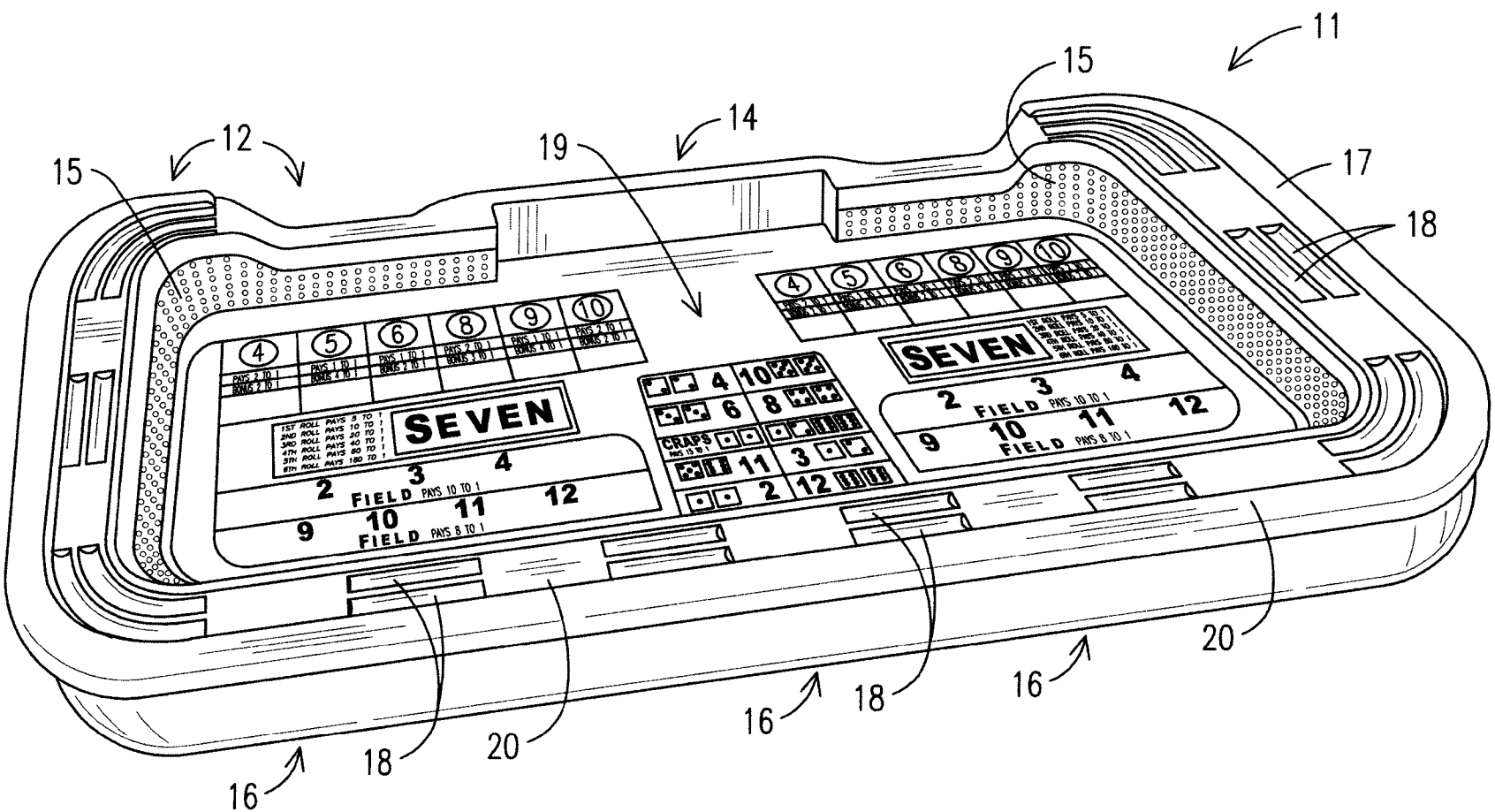
FIG. 1 is a perspective view illustrating one embodiment of a game table for playing a bingo game according to the present invention.

Referring now in more detail to the drawing figures, wherein like reference numbers indicate like parts throughout the several views, FIG. 1 is a top perspective view of a game table for playing bingo according to one embodiment of the invention. It will be seen at first glance that the game table is made to resemble or mimic the look of a craps table for playing the traditional casino game of craps. More specifically, the game table 11 includes an elongated table 12 preferably made of wood and supported above the floor at a comfortable playing height by legs (not visible). The elongated table 12, which preferably is the size of a traditional craps table, has a table top 19 surrounded by upstanding walls or parapets 15. The inside surfaces of the upstanding parapets 15 may be covered with rubber bumpers to resemble the bumpers of a traditional craps table.

The table top 19 is covered with a felt playing surface printed with graphics and indicia that are used by players to purchase bingo cards during game play. The specific graphics and indicia of the preferred embodiment are discussed in more detail below with respect to FIG. 2. However, it will be appreciated from FIG. 1 that the felt playing surface evokes the appearance of the playing surface of a traditional craps table one might see in a Las Vegas casino. A bingo dealer station 14 is located at one side of the table 12 where the bingo dealer stands during game play. A number of player stations 16 are arrayed about the opposite side and ends of the table 12 where bingo players can stand as they play bingo games. The player stations may include padded arm rests 17 and chip trays 18 for the convenience of the players and to enhance the look and feel of a traditional craps game as the players engage in bingo games. Flat areas 20 may be provided as a convenient place for players to rest bingo cards during play. As mentioned, the table 12 preferably is about the size of a traditional craps table, but may be any size to accommodate space constraints where bingo games are played. In one preferred embodiment, the table 12 measures 12 feet by 4 feet with a visible playing surface measuring 10 feet by 44 inches.

Figure 2:
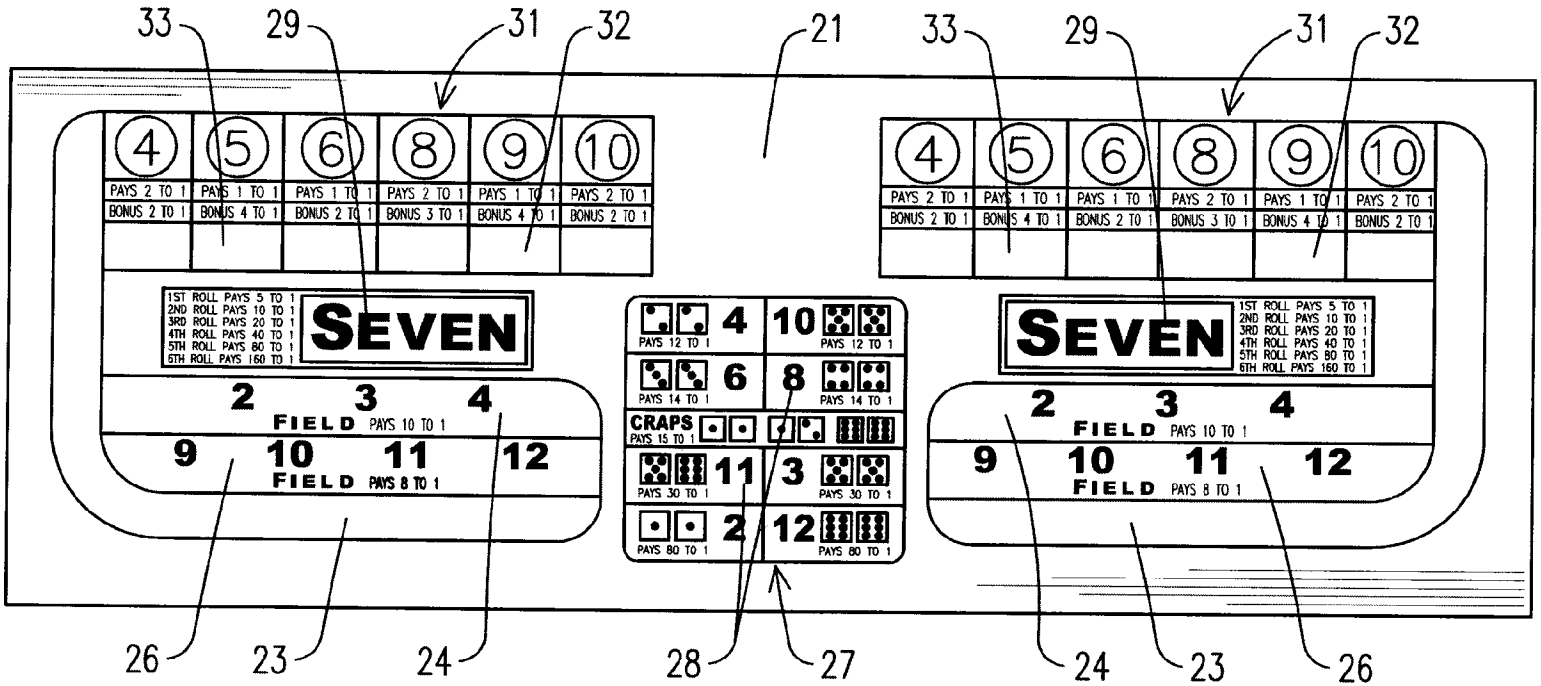
FIG. 2 is a plan view of the top of the game table of FIG. 1 illustrating the various positions on the board for purchasing Bingo cards.

FIG. 2 is a detailed plan view of the felt playing surface of the preferred embodiment of the invention. The playing surface is printed with graphics and indicia used during bingo play and, as mentioned, the graphics and indicia are designed to evoke the appearance of a traditional craps table playing surface in order to enhance the experience of playing bingo according to the invention. More specifically, a bingo line 23 extends along each end of the playing surface and wraps around and extends partially along the player side of the playing surface. In this way, the bingo line is easily accessible to all players. It can be seen that the bingo line evokes the appearance of a "pass" line of a traditional craps table.

A first Field 24 and a second Field 26 appear above the portion of each bingo line that extends along the player side of the table. In the preferred embodiment, the each first Field 24 bears the numbers 2, 3, and 4 and each second Field 26 bears the numbers 9, 10, 11, and 12. Odds or payout ratios are associated with and printed in the first and second Fields. More specifically, each of the first Fields 24 is printed with the legend "PAYS 10 TO 1" and each of the second Fields 26 is printed with the legend "PAYS 6 TO 1." These payout designations indicate the payouts that are paid to players who win Interim Bingo Games associated with the first and second Fields on the playing surface, as detailed below.

A Proposition region 27 is printed on the playing surface in the lower central portion thereof. The Proposition region is printed with graphics that are designed to evoke the appearance of a Proposition bet location on a traditional craps table.

As explained in detail below, players can purchase Interim Bingo Game cards for areas 28 of the Proposition region during a bingo game by placing chips in one of the areas prior to a roll of a bingo ball. These areas contain images of pairs of dice that correspond to the two digits on a bingo ball used during game play. For instance, the dice pair in the upper left area of the Proposition region corresponds to a bingo ball bearing the number 22 and the sum of the digits, 4 in this case, is printed in area next to the dice images. Similarly, the area of the Proposition region bearing the number 11 is printed with images of a pair of dice showing numbers 5 and 6 (which sum to 11) corresponding to a bingo ball bearing the number 56. The central area of the Proposition region has dice images corresponding to numbers 11 (snake eyes), 12 (ace deuce), and 66 (boxcars) on a bingo ball that may be selected or rolled during game play. Payouts associated with each area 28 of the Proposition region 27 are printed in the corresponding areas. The purchase of interim bingo cards in these areas is accomplished by placing chips in these areas, which may be referred to as Hard Way areas since, as detailed below, a bingo ball bearing a specific two digit number is required to win an Interim Bingo Game played in the Proposition region of the playing surface.

A Sevens position 29 is printed on the playing surface above each of the first and second Fields 24 and 26 roughly where a come line would appear on a traditional craps table. Players may place chips in one of the Sevens positions to purchase a bingo card for an Interim Bingo Game associated with the Sevens position. The word "SEVEN" is printed in each of the Sevens positions and a series of payouts are printed next to the Sevens position corresponding to progressive rolls of bingo balls during play with two digits that sum to the number 7. A player may purchase a Sevens interim bingo card by placing a chip on the Sevens position at the beginning of a bingo session. If the first bingo ball rolled has digits totaling seven, the player receives a first payout. If the second bingo ball rolled has digits totaling seven, then the player receives a second higher payout and so on. The payout associated with each successive bingo ball with digits totaling seven increases as indicated by the payouts printed next to the Sevens positions.

Above each Sevens position is printed a Points Bonus position containing six areas bearing numbers where players may place chips to purchase bingo cards for an associated Interim Bingo Game. The numbers 4, 5, 6, 8, 9, and 10 are printed in each area of the Points Bonus position and below each number is printed payouts for winning (e.g. "PAYS 2 TO 1") and bonus payouts (e.g. "BONUS 4 TO 1"). Below this is a region where a player may place chips indicating that he or she wishes to purchase an Interim Bingo card associated with the number printed above. Again, the numbers in the Points Bonus position correspond to the sum of a two digit number that appears on a bingo ball during game play. Further, any two digits of a bingo ball number that sum to the indicated number is a win of the Points Bonus Interim Bingo Game as explained in more detail below.

Figure 3:
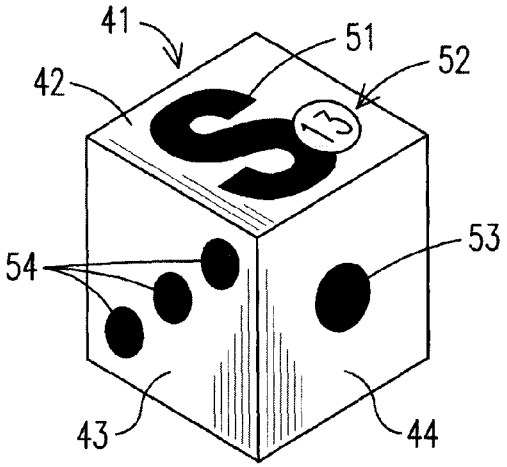
FIG. 3 is a perspective view of a cube-shaped bingo ball according to principles of the invention.
Figure 4:
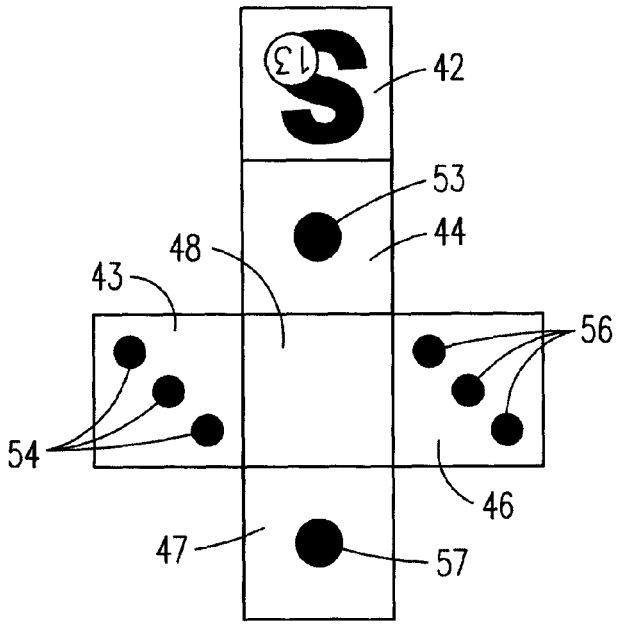
FIG. 4 is a plan view of an unfolded bingo ball showing one embodiment of markings on each face of the bingo ball.

FIG. 3 illustrates one embodiment of a cube-shaped bingo ball to be used during play of bingo games according to the invention. FIG. 4 shows the cube-shaped bingo ball unfolded and flattened to reveal all six sides of the bingo ball illustrated in FIG. 3. The bingo ball 41, which is one of 76 such balls used during game play, is cube-shaped rather than spherical like traditional bingo balls. In this way, the bingo balls of the present invention evoke the appearance of dice used during play of a traditional craps game. In the illustrated embodiment, one face 42 of the cube-shaped bingo ball is printed with a letter (indicated by reference number 51 in FIG. 3) and a number (indicated by reference number 52 in FIG. 3), the letter corresponding to a column on a bingo card and the number corresponding to a number contained within that column.

In the illustrated embodiment of FIGS. 3 and 4, the bingo ball is printed with the letter and number combination "S-13." Four of the remaining sides 43, 44, 46, and 47 of the bingo ball 41 are printed with dots that represent the two digits of the number associated with the bingo ball. Here, that number is 13 and so two of the four sides of the cube-shaped bingo ball are printed with one dot (corresponding to the digit 1) and the other two sides are printed with three dots (corresponding to the digit 3). The remaining side of the cube-shaped bingo ball is printed in this embodiment with a logo, but may be printed with other graphics as desired. FIGS. 3 and 4 show an example of a bingo ball bearing a number (13) used for playing Interim Bingo Games and is a number that may appear in the "O" and "S" columns of interim bingo cards (described below). Combinations such as "O-01" and "S-75", for instance, which do not correspond to a possible result of a dice roll do not have dice dots. The numbers on these bingo balls are used for playing the Primary Bingo Game and are numbers that may appear in the "O" and "S" columns of Primary Bingo Game cards.

Figure 5:
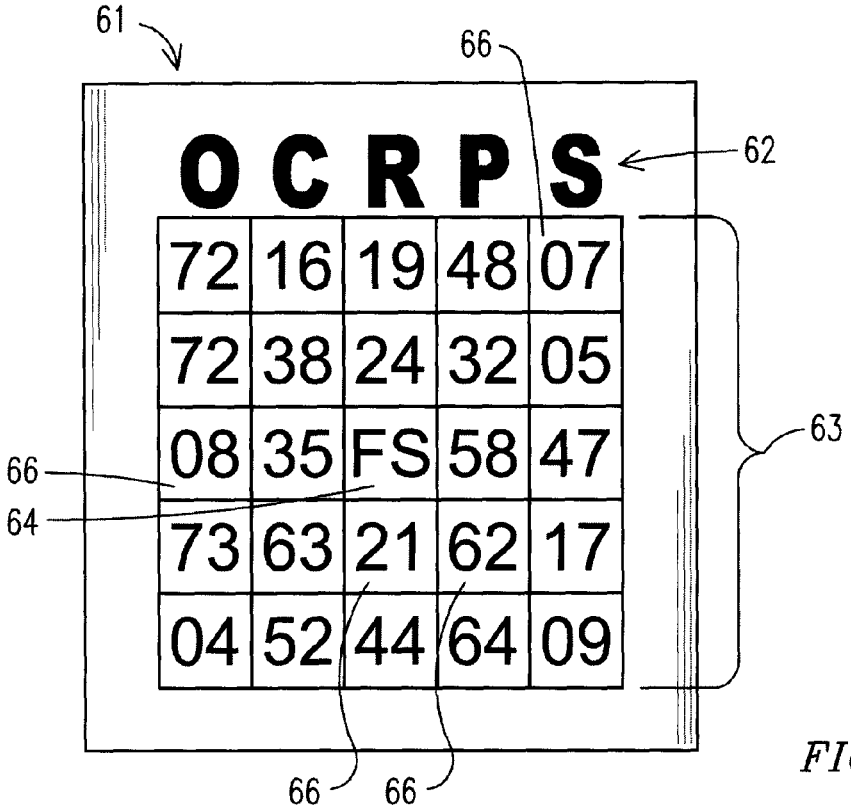
FIG. 5 illustrates one embodiment of a bingo card for playing the bingo table game of the present invention.

FIG. 5 shows an example of a bingo card used for playing bingo according to the present invention. The illustrated embodiment is a card for playing a Primary Bingo Game, but cards for playing Interim Bingo Games differ only in the set of numbers that may appear in their "O" and "S" columns. The bingo card 61 comprises a 5 by 5 matrix 63 of spaces headed by a header row 62 of five letters, one letter for each column of the five columns of the matrix. The header row is printed in this embodiment with the letters O C R P S with each letter corresponding to a column of the matrix below. The center space of the matrix is designated a "free" space and is printed with the legend "FS" to indicate that it is indeed a free space. Each of the remaining 24 spaces of the matrix is printed with a two digit number (indicated by reference number 66) in the range of 01 to 75. At least some of the numbers are selected from numbers printed on the 76 bingo balls used during play of a Bingo Session according to the invention. Other numbers may be selected from numbers that do not appear on bingo balls, referred to herein as "null" numbers, and are used to fill cells of the matrix but cannot be matched by any of the bingo balls. In the preferred embodiment, the bingo card 61 may be made with a dry erasable surface so that players can daub numbers matching those on randomly selected bingo balls during play, and the card can be erased for reuse in a subsequent bingo game. At the end of each Primary Bingo Game and Interim Bingo Game, the players surrender their Bingo cards to be reissued upon new purchases prior to the next Bingo ball roll.

Two types of bingo cards are provided for playing bingo games according to the invention; namely, primary bingo cards and interim bingo cards. Primary bingo cards are used for playing Primary Bingo Games and interim bingo cards are used for playing Interim Bingo Games. Primary bingo cards differ from interim bingo cards in that a primary bingo card bears at least one two digit number in its "O" and "S" columns with digits that do not correspond to a possible result of a roll of a pair of dice. The example shown in FIG. 5 is seen to be a primary bingo card in that the numbers in its "O" and "S" columns (e.g. 72, 08, 04, 47, and 17) are not made up of digits that can result from a roll of a pair of dice. Interim bingo cards, on the other hand, have at least one number in their "O" and "S" columns with digits that do correspond to a possible result of a roll of a pair of dice. These columns of an interim bingo card might include, for instance, numbers such as 11 (corresponding to snake eyes), 34 (corresponding to a 3 and a 4), 66 (corresponding boxcars), etc. More completely, interim bingo cards have at least one number in their "O" and "S" columns selected from the set of thirty-six numbers S-11, O-12, S-13, O-14, S-15, O-16, S-21, O-22, S-23, O-24, S-25, O-26, S-31, O-32, S-33, O-34, S-35, O-36, S-41, O-42, S-43, O-44, S-45, O-46, S-51, O-52, S-53, O-54, S-55, O-56, S-61, O-62, S-63, O-64, O-65, S-66. There is one bingo ball bearing each of these numbers for a total of 36 balls. Similarly, bingo cards for playing Primary Bingo Games have numbers in their "O" and "S" columns selected from the set of twenty numbers S-01, O-02, S-03, O-04, S-05, O-06, S-07, O-08, S-09, O-10, S-17, S-27, S-37, S-47, S-57, O-71, O-72, O-73, O-74, and O-75. There are two bingo balls bearing each of these numbers for a total of forty, which, with the 36 interim bingo balls, makes up the set of 76 bingo balls.

There is a set of numbers that are not used on bingo balls either in combination with an "O" or an "S." In one embodiment, this is the set of nineteen numbers 18, 19, 20, 28, 29, 30, 38, 39, 40, 48, 49, 50, 58, 59, 60, 67, 68, 69, and 70. These may be referred to as "null" numbers since they cannot represent a winning roll of a bingo ball in any Primary Bingo Game or Interim Bingo Game as they do not appear on any bingo balls. These null numbers may be used, however, on bingo cards in the "O", "S", and other columns as place fillers so that all cells of the 5 by 5 matrix except the center Free Space contain a number.

Figure 6:
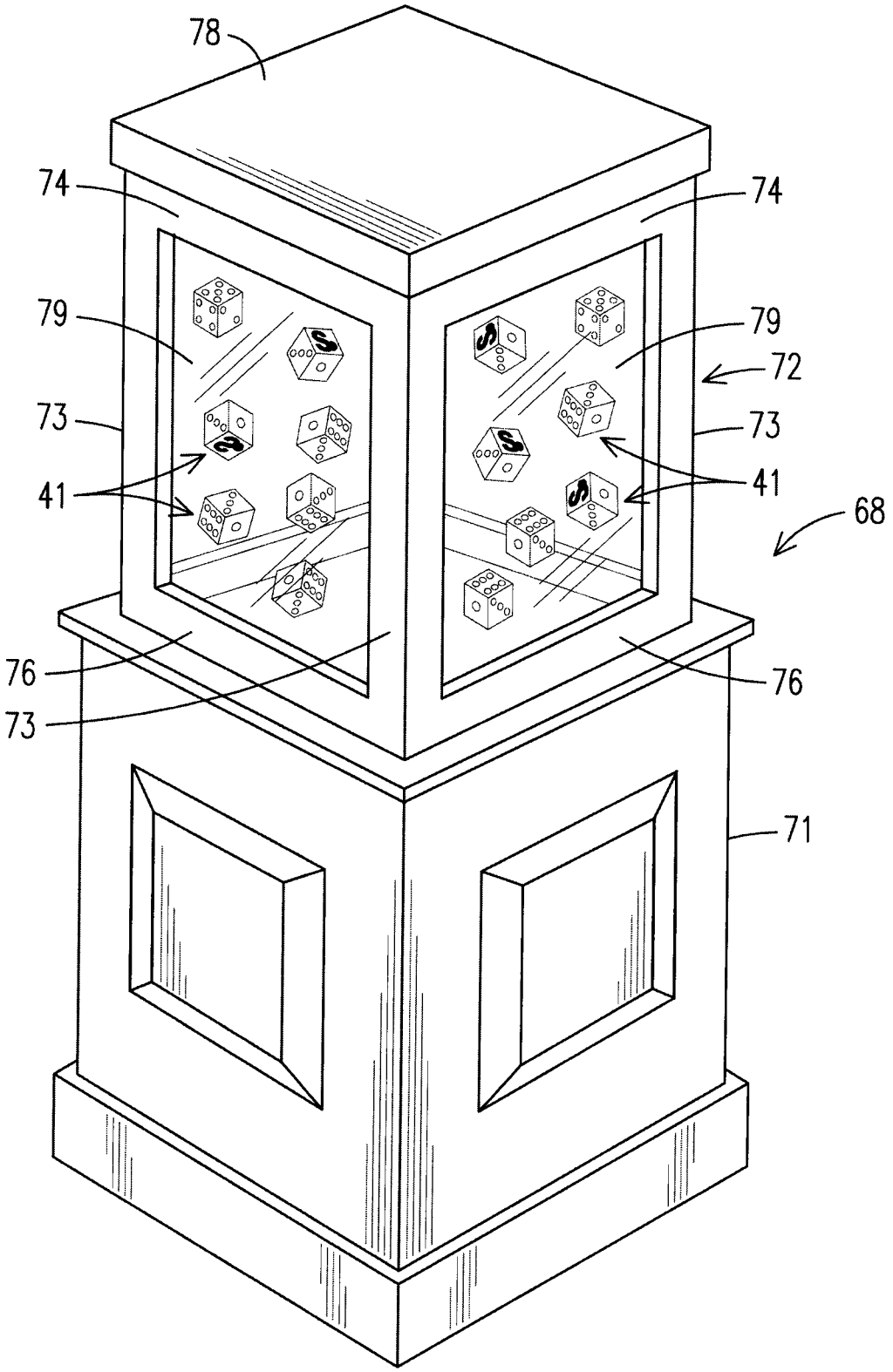
FIG. 6 illustrates one possible embodiment of a bingo ball blower for randomizing bingo balls before one is selected and rolled across the game table.

A bingo ball blower is used during game play to randomize the 76 bingo balls and to eject a single randomly selected bingo ball upon command. FIG. 6 shows one example of such a blower. It should be understood, however, that a bingo ball blower of virtually any configuration might be used to eject randomly selected bingo balls within the scope of the invention. In the illustrated example, the blower 68 has a stand 71 that houses the fan and electronics associated with the blower. The stand 71 supports an upper portion of the blower that is formed with vertical corner stanchions 73, horizontal bottom rails 76, and horizontal top rails 74 that define frames on the four sides of the top portion 72. Glass panes are mounted within the frames and cube shaped bingo balls 41 as described above are contained within the upper portion of the blower. During operation, a fan within the blower keeps the bingo balls suspended and tumbling so that they are randomized. Preferably, a chute (not shown) can be accessed by the bingo dealer in such a way that a single random bingo ball is selected from the balls in the blower and ejected down the chute onto the playing surface of the bingo table in such a way that it tumbles across the playing surface, again evoking a dice roll in a traditional craps game.

The Method of Playing Bingo

Having described the table and other components of the bingo game, a method of playing bingo according to the invention will now be detailed. To begin a bingo game, at least two players must purchase a Primary Bingo Game card by placing a chip on the bingo line 23 of the playing surface and receiving a Primary Bingo Game card 61 from the bingo dealer at the dealer station 14. This bingo card will be used by each player to participate in a Primary Bingo Game. Once the Bingo Dealer is satisfied that all players at the table have purchased their primary bingo card, the table is open for the players to purchase Interim Bingo Game cards by placing chips on desired positions. The Bingo Dealer then issues the players the appropriate Interim Bingo Game card or cards. This step is repeated prior to the draw of the next bingo ball. Placing chips on a position or Field constitutes purchase of the interim bingo card corresponding to that position or Field. The corresponding interim bingo card has at least one number in its "O" and/or "S" columns corresponding to the numbers associated with the selected position or field and that can represent a winning match if a matching bingo ball is selected. Numbers in other cells of the "O" and "S" columns (and other columns as well) may be selected from the set of null numbers to fill in the cells with numbers that will never be drawn. A player then hopes that a ball that matches a number in the "O" or "S" column of his or her interim bingo card is rolled on the next selection of a bingo ball.

Play of the Primary Bingo Game proceeds as follows. When the bingo dealer is satisfied that all players have purchased a primary bingo card by placing a chip on the bingo line and that all desired interim bingo cards have been purchased, the first bingo ball is drawn. The blower propels a randomly selected bingo ball down a chute and it tumbles across the playing surface mimicking a dice roll. Once the bingo ball settles, it is picked up by the bingo dealer and its designation (letter and number) is verbally announced to the players. Each player then examines his or her primary bingo card and daubs or otherwise marks any designation (column and number) on the primary bingo card that matches that of the bingo ball. For instance, if "O-27" is called and a player has a number 27 in the "O" column of his or her primary bingo card, then the number 27 will be daubed by the player in the "O" column of his or her primary bingo card after the call. A player wins the Primary Bingo Game when he or she has daubed at least one matching number in the "O" column and at least one matching number in the "S" column of his or her primary bingo card. Winning players then declare "BINGO" and, after confirmation, receive (or split if there is more than one winner) all chips from the bingo line, which represent all purchases by all players of a primary bingo card. The Primary Bingo Game then ends in preparation for a next successive Primary Bingo Game. A Primary Bingo Game lasts for at least two rolls of a bingo ball, and usually lasts for several rolls.

During play of a Primary Bingo Game, players can play any of a number of Interim Bingo Games, which can be won on a single draw of a single bingo ball. In general, Interim Bingo Games proceed as follows. After the purchase of a bingo card for a Primary Bingo Game and before each bingo ball is drawn, a player may purchase an interim bingo card by placing a chip or chips on any of the Field, Proposition, Hard Way, and Points Bonus positions on the bingo table (see FIG. 2). All purchases of these interim bingo cards must be made before the start of each Interim Bingo Game, i.e. before the next draw of a bingo ball. To purchase a Sevens position interim bingo game card, a player places a chip in the Sevens position at the beginning of each Primary Bingo Game before the first bingo ball is drawn. The Sevens position Interim Bingo Game remains open and the chips stay in place for successive bingo ball rolls until a bingo ball with digits not totaling seven is drawn or the Primary Bingo Game ends. The Sevens position may thus be referred to as a progressive Interim Bingo Game.

Once all desired interim bingo cards are purchased, the bingo dealer causes the blower to eject the next randomly drawn bingo ball. Players then check their interim bingo cards and daub any number on these cards that match the designation of the bingo ball. An Interim Bingo Game card holder wins the corresponding Interim Bingo Game by daubing a previously designated arrangement of numbers on the interim bingo card that match numbers on randomly drawn bingo balls during the game. In a preferred embodiment, the designated arrangement is simply one daubed number in either the "S" column or the "O" column of an interim bingo card. Each interim bingo card corresponding to a particular Interim Bingo Game has at least one winning number that bears some relationship to the Interim Bingo Game position where its player placed his or her chip to purchase the card. For example, a Hard 4 interim bingo card will have the number "22" in the "O" or "S" column on the card corresponding to a "two pair" dice roll. Other cells in the columns may be filled with null numbers.

After each roll of a bingo ball, interim bingo card holders having cards with a match in their "O" or "S" column (or any other designated winning pattern) are winners, and are paid according to the payout associated with the Interim Bingo Game position corresponding to the card. Interim bingo card holders having cards without a match are not winners. Winners receive chips according to the payout associated with the Interim Bingo Game that was won. Each Interim Bingo Game then ends and players may prepare for the next round of Interim Bingo Games by placing chips on Interim Bingo Game positions to purchase interim bingo cards to be used with the next successive roll of a bingo ball. It will thus be seen that Interim Bingo Games can be won on a single roll of a bingo ball, and thus lend speed and excitement to the overall bingo game of this invention.

Interim Bingo Games continue on each roll of a bingo ball until one or more players win the Primary Bingo Game and declare "BINGO." At this point, the overall Bingo Session comprising the Primary Bingo Game and the corresponding set of Interim Bingo Games ends and a new Bingo Session begins anew and play continues in the same manner over and over again. Game play for each of the positions on the playing surface will now be described in more detail.

Field and Proposition Positions

Field and Proposition positions on the playing surface are Field (2,3,4), Field (9,10,12), Craps (2,3,12), Eleven (11), Ace-Deuce (3), Snake Eyes (11), and Box Cars (12). During a Primary Bingo Game, a player may play any of the Field and Proposition Interim Bingo Games by placing a chip or chips on any of the Field and/or Proposition positions of the playing surface, thereby purchasing a corresponding interim bingo card. The interim bingo cards corresponding to a Field or Proposition position have numbers in their "O" and "S" columns with digits that sum to numbers associated with their Field or Proposition. For instance, a Field (2,3,4) interim bingo card may have some numbers in its "O" and "S" columns such as 31, 21, 13, 04, 11 and the like with digits that sum to 2, 3, or 4. Other cells in the columns may be filled with null numbers. Thus, a player hopes for a bingo ball with a number whose digits sum to 2, 3, or 4 allowing the player to daub a winning number on the interim bingo card. Accordingly, when a player wins the interim bingo game, it evokes the sense that the win is associated with the Field (2,3,4) where the bingo card was purchased.

When the bingo dealer is satisfied that all interim bingo cards are purchased, the next bingo ball is randomly drawn. The interim bingo player holding a Field or Proposition bingo card then daubs any numbers on his or her card that match the designation (column and number) on the drawn bingo ball. A daubed number in either the "O" column or the "S" column wins and all winners are paid according to the payouts associated with their Field and Proposition bingo card purchases. Players with no matching numbers daubed do not win the Interim Bingo Game associated with their Field and Proposition bingo cards. New Field and Proposition bingo card purchases may then be made in preparation for the next draw of a bingo ball and a new interim Field and Proposition bingo game begins on the next roll and announcement of a bingo ball.

Interim Field and Proposition bingo games can be played so long as the Primary Bingo Game continues without a winner. A winner or winners of the Primary Bingo Game ends the Bingo Session, chips remaining on the Field and Proposition positions (as well as chips remaining on the Sevens and Point Bonus positions) are removed and retained by the house. The chips on the line where all players initially purchased their primary bingo cards are paid to the winner or winners of the Primary Bingo Game upon verification of BINGO. A new Bingo Session may then be started with two or more players placing chips on the line to purchase Primary Bingo Game cards, and so on.

Hard Way Positions

The "Hard Way" positions on the playing surface are the positions Hard 4, Hard 10, Hard 6, and Hard 8. During a Primary Bingo Game, a player may play any of the interim Hard Way bingo games by placing a chip or chips on any of the Hard Way positions. This entitles the player to purchase an interim Hard Way bingo card, having at least one potentially winning number in its "O" column or its "S" column. For example, a Hard 6 interim bingo card will have the number "33" in its "O" column or its "S" column and remaining cells of these columns may be filled with null numbers. On the next roll of a bingo ball, a player with a Hard Way Bingo card will either win or lose. If a player wins, he or she daubs the winning match on his or her interim bingo card is paid according to the payout associated with the Hard Way position bearing his or her chips. All chips remain on the Hard Way positions for subsequent interim games unless (a) a soft equivalent is drawn or (b) the designated Primary Bingo Game winning pattern is achieved, in which case all interim games are over and chips used to purchase interim bingo cards are removed and retained by the house. The winning and losing numbers for each interim Hard Way bingo game for the Hard Way positions are as follows:

Hard 4: "O-22" or "S-22" wins; all other combinations lose

Hard 10: "O-55" or "S-55" wins; all other combinations lose

Hard 6: "O-33" or "S-33" wins; all other combinations lose

Hard 8: "O-44" or "S-44" wins; all other combinations lose

As with all Interim Bingo Games, all interim Hard Way bingo games for a Bingo Session end when one or more players wins the Primary Bingo Game of the session.

Sevens Position

The Sevens position on the playing surface are the regions marked with the word SEVEN. During the Primary Bingo Game of a Bingo Session, a player may play the interim Sevens bingo game by placing a chip or chips on the Sevens position prior to the first bingo ball roll of a bingo session. This constitutes purchase of a corresponding Sevens interim bingo card, which the bingo dealer provides to the player. The first bingo ball is then randomly drawn and the interim Sevens player daubs any matching numbers on his or her interim Sevens bingo card. A matching number in either the "O" column or the "S" column of the player's interim Sevens bingo card with digits that sum to seven designates that the player is a winner.

If there is a winning number daubed on the player's interim Sevens bingo card after the first bingo roll, the player receives a payout of 5 chips to 1 chip for his chips in the Sevens position. The original chip then stays in place on the Sevens position and the second bingo ball is rolled. If this bingo ball also matches a number that sums to seven on the players interim Sevens bingo card, the match is daubed on the player's interim Sevens bingo card, then the player receives a payout of 10 to 1. This continues successively so long as numbers on the player's interim Sevens bingo card with digits that sum to seven continue to match successive draws of bingo balls up to six draws. If this in fact happens for six successive draws, the payout is 160 to 1 for each player that purchased an interim Sevens bingo card. The payout for each successive winning draw is marked next to the Sevens positions. However, upon the first draw of a bingo ball without a matching number on the payer's interim Sevens bingo card, the player loses, his or her chips are removed by the bingo dealer, and no subsequent roll of a seven will result in a win or payout for the player. The Sevens position is then said to be "closed out."

The interim Sevens bingo game for all players ends when a player achieves the game winning pattern in the Primary Bingo Game, or when a bingo ball is drawn bearing the number 11, 12, 13, 14, 15, 21, 22, 23, 24, 26, 31, 32, 33, 35, 36, 41, 42, 44, 45, 46, 51, 53, 54, 55, 56, 62, 63, 64, 65, or 66 (these are the numbers used in the "O" and "S" columns of interim Sevens bingo cards) and the interim Sevens player daubs a matching number on his or her interim Seven bingo card. While the Primary Bingo Game is open, the interim Sevens player continues to play the interim Sevens bingo game until a losing number is rolled or the Primary Bingo Game ends.

The Points Bonus Position

The Points Bonus positions on the playing surface are the positions Top Position 4, Top Position 5, Top Position 6, Top Position 8, Top Position 9, and Top Position 10. During a Primary Bingo Game of a Bingo Session, a player may play an interim Points Bonus bingo game by placing a chip or chips on one of the Interim Point Bonus Positions, thereby purchasing a corresponding Points Bonus bingo card. When each bingo ball is drawn, an interim Points Bonus game player daubs any number on his or her interim Points Bonus bingo card that matches the number on the bingo ball. When the match is confirmed, the player is paid the payout associated with the position containing the player's chips. The bingo dealer will place a marker or "point" near these positions when this occurs. When a player wins the Primary Bingo Game of the Bingo Session, players with chips on this "point" position are paid the bonus payout associated with the position.

The invention has been described herein in terms of preferred embodiments and methodologies considered by the inventor to represent the best mode of carrying out the invention. It will be understood by the skilled artisan; however, that a wide range of additions, deletions, and modifications, both subtle and gross, may be made to the illustrated and exemplary embodiments without departing from the spirit and scope of the invention. The essence of the invention is a bingo table game and method of playing bingo that lends fun and excitement to the game of bingo by playing bingo within a setting that evokes the sense of playing the traditional game of craps, or other traditional gambling games for that matter. However, the fanciful graphics on the playing surface are in no way used to determine the outcomes of primary and Interim Bingo Games being played on the table. Accordingly, a wide range of modifications, additions, deletions, and refinements might be made to the examples presented in this disclosure, all within the scope of the invention, which is determined by the claims hereof.

What is claimed is:

1. A bingo table game system comprising:

a table having an elongated playing surface at least partially surrounded by an upwardly extending peripheral parapet;

a plurality of player stations arrayed around the table;

a dealer station located on one side of the table;

the playing surface having graphics thereon;

a plurality of chips;

a plurality of Primary Bingo Game cards usable by one or more players while playing a bingo table game;

a plurality of Interim Bingo Game cards usable by one or more players while playing a bingo table game;

the graphics having at least one first region designated for receiving from one or more players chips used to purchase Primary Bingo Game cards for playing a Primary Bingo Game;

the graphics having at least one second region designated for receiving from one or more players chips used to purchase Interim Bingo Game cards for playing at least one Interim Bingo Game during play of a Primary Bingo Game;

a plurality of bingo balls having designations thereon, at least some of the designations on the bingo balls corresponding to a location on the primary bingo cards and the interim bingo cards;

a mechanism associated with the table for identifying a random one of the plurality of bingo balls during play of Primary Bingo Games and Interim Bingo Games; and the at least one second region having indicia therein that conveys a payout associated with a win of the at least one Interim Bingo Game.

2. A bingo table game as claimed in claim 1 wherein the bingo balls are non-spherical.

3. A bingo table game as claimed in claim 2 wherein the bingo balls are cube-shaped.

4. A bingo table game as claimed in claim 1 wherein the mechanism comprises a blower.

5. A bingo table game as claimed in claim 1 wherein the playing surface is felt and the graphics are on the felt.

6. A bingo table game as claimed in claim 1 wherein the at least one second region comprises a plurality of second regions.

7. A bingo table game as claimed in claim 6 wherein at least one of the plurality of second regions is identified by the graphics as a Field region.

8. A bingo table game as claimed in claim 6 wherein at least one of the plurality of second regions is identified by the graphics as a Proposition region.

9. A bingo table game as claimed in claim 6 wherein at least one of the plurality of second regions is identified by the graphics as a Sevens region.

10. A bingo table game as claimed in claim 1 further comprising a bumper extending around an inside surface of the peripheral parapet.

* * * * *